US006818846B2

(12) United States Patent
Roberts

(10) Patent No.: US 6,818,846 B2
(45) Date of Patent: Nov. 16, 2004

(54) OVERTOGGLED INTERRUPTER SWITCH ASSEMBLY

(75) Inventor: Gerald Bernard Roberts, Monroe, MO (US)

(73) Assignee: Hubbell Incorporated, Orange, CT (US)

( * ) Notice: Subject to any disclaimer, the term of this patent is extended or adjusted under 35 U.S.C. 154(b) by 77 days.

(21) Appl. No.: 10/230,082

(22) Filed: Aug. 29, 2002

(65) Prior Publication Data

US 2003/0000818 A1 Jan. 2, 2003

Related U.S. Application Data

(63) Continuation of application No. 09/457,593, filed on Dec. 9, 1999, now Pat. No. 6,459,053.

(51) Int. Cl.[7] ..... H01H 3/20
(52) U.S. Cl. ..... 200/331; 200/48 A
(58) Field of Search ..... 200/331, 48 KB, 200/48 SB, 48 A, 48 R–48 CB, 49, 12; 218/14, 16, 17, 20, 1, 152–154, 21

(56) References Cited

U.S. PATENT DOCUMENTS

| | | | | |
|---|---|---|---|---|
| 2,737,556 A | | 3/1956 | MacNeill et al. | |
| 3,637,959 A | * | 1/1972 | Bridges | 200/48 R |
| 4,027,125 A | | 5/1977 | Peek et al. | |
| 4,049,936 A | | 9/1977 | Frink et al. | |
| 4,090,051 A | | 5/1978 | Frink et al. | |
| 4,110,579 A | | 8/1978 | Frink et al. | |
| 4,622,443 A | | 11/1986 | Mooz | |
| 5,457,292 A | | 10/1995 | Harr | |
| 5,483,030 A | | 1/1996 | Bridges | |
| 5,821,486 A | * | 10/1998 | Paw et al. | 200/48 A |

* cited by examiner

*Primary Examiner*—Michael Friedhofer
*Assistant Examiner*—Lisa Klaus
(74) *Attorney, Agent, or Firm*—Marcus R. Mickney; Alfred N. Goodman; Mark S. Bicks

(57) ABSTRACT

A group operated overhead switch for high voltage power lines includes a rotatable overtoggle mechanism linked to a control shaft and a plurality of switch phases secured to a crossarm support. The overtoggle mechanism may be rotated to and from a closed position and an open position, either or both of which may be overtoggled, that provides the operator with an affirmative snap when the switch is moved into an overtoggled position. The use of switch assemblies made of rotatable switch phases and a corresponding immobile electrical connector mounted on the same assembly support allows factory manufacture of modular switch assembly components for high quality control, consistent performance, and accurate component alignment. The supported switch assemblies are then mounted under factory controlled conditions on a dimensionally stable support crossarm and linked by group operated linkages with a switch overtoggle mechanism for actuation. The entire switching assembly may be mounted on a utility pole as a pre-manufactured unit.

17 Claims, 3 Drawing Sheets

OVERTOGGLED INTERRUPTER SWITCH ASSEMBLY

RELATED APPLICATION

This is a continuation of U.S. application Ser. No. 09/457,593, filed Dec. 9, 1999, now U.S. Pat. No. 6,459,053, which claims the benefit thereof under 35 U.S.C. §120 and the subject matter of which is hereby incorporated by reference.

FIELD OF THE INVENTION

The invention relates to overtoggled operating mechanisms for high voltage interrupting switches used for overhead power distribution systems that provide secure closure forces adjacent the switches to prevent against accidental blade openings. The invention is particularly useful for plural switch systems such as those found in three switch phase systems used on overhead power lines.

BACKGROUND OF THE INVENTION

Overhead electric power distribution lines are supported on utility poles that may be 40–50 feet high. Horizontal supports mounted to the pole often carry various distribution apparatus. Because such distribution lines commonly operate in a three-phase system with three lines mechanically connected to the horizontal support and electrically insulated from each other, there are three associated lines that ordinarily must be switched and reconnected simultaneously for maintenance or rerouting of power. This simultaneous switching process requires some form of group operated switch system.

Group operated circuit switching devices have rotatable or sliding parts that are exposed to the weather where they may become corroded, or where they may become immobilized in the winter because of ice formed on the parts. Exposed components of a switching device are not easily operated and, in addition, are often aesthetically undesirable.

Currently, many high voltage switch operating mechanisms for overhead power distribution lines rely on a handle connected to a control shaft that passes up the utility pole to a rotatable bearing on one of the three switch phases near or at the horizontal support beam. For example, see U.S. Pat. No. 5,483,030, the disclosure of which is hereby incorporated by reference. A universal control section is securely connected to the rotatable switch phase bearing so that rotation of the bearing is translated into lateral displacement of an interphase shaft along the horizontal support beam. Conductive switch blades on each switch phase connection can be rotated into or out of electrical connection with their respective phase lines. When the handle on the control shaft is rotated, the interphase shaft rotates the switch phases. Load interrupters of the type described in U.S. Pat. No. 5,457,292, which is hereby incorporated by reference, suppress the formation of damaging arcs as the switch blades are opened.

High voltage switches are typically mounted well above ground and experience a variety of externally applied forces from weather, utility pole deformation, and vibration that can tend to open the high voltage contacts over time. Thus, the handle on the control shaft must maintain the security required to prevent unintended opening of the conductive blades. It would be a desirable advance in the art to provide an improved means independent of the handle and control shaft for securing high voltage overhead power switch blades in a closed position for service, while still allowing opening of the switch blades for maintenance.

Unfortunately, the use of a control shaft that passes up through the length of the utility pole represents a source of maintenance. It would be desirable to have a switch mechanism for high voltage overhead power systems that did not require the use of a handle and control shaft running the height of the utility pole to hold the switch blades in a closed position. If a handle was used, however, the switch mechanism would provide a means atop the pole for securing the switch components in a closed position, thereby reducing the criticality of a securing system for the ground level handle.

Traditionally, group operated switch assemblies were installed and adjusted in the field to form an overhead switching system. A typical three phase installation would include a pair of parallel horizontal support beams mounted to an upright pole. The two support beams would support the three phases and conductor tension dead ending.

The field installation required installation of three individual phases and one or more interphase shafts with subsequent adjustment control arm linkages between the switch phases for proper blade opening and closing positions. These steps were often performed atop the support pole under circumstances that were less than ideal for consistent alignment. Periodic inspection was required to prevent against premature wear or damage to the switch due to loss of proper adjustment through vibration, weathering of support components, and dimensional changes in the utility pole (e.g., twisting).

It would be desirable to have a group operated switch assembly for high voltage power lines that could be a pre-assembled switch with overtoggled operation. Manufacturing under the controlled conditions of a factory could result in a high degree of reliability and operation that would resist fluctuations in component positions over an extended period of exposure to outdoor weather.

SUMMARY OF THE INVENTION

It is an object of the invention to provide a means for securing a switch assembly in a closed and/or open position.

It is also an object of the invention to provide a switch system for high voltage three phase distribution systems that provides forces to maintain the switchblades in a closed and/or open position despite ambient wind, weather, and vibration.

A further object of the invention is a high voltage overhead distribution system switching assembly that can be pre-manufactured under controlled manufacturing conditions. The manufacture would preferably rely on a modular construction of phase switches for all the benefits that normally flow from modular systems, i.e., higher quality, lower cost, enhanced reliability, better engineering design, etc.

In accordance with these and other objects of the invention that will become apparent from the description herein, the high voltage switching assembly of the invention includes a plurality of switch phases rotated between closed and open positions by pivotable, rigid connection arms operated by a rotatable overtoggle mechanism having an open position and a closed position. Either or both of the open and closed positions may be overtoggled to secure the switch blades in position.

In a particularly preferred embodiment of the invention, a group operated circuit switching apparatus according to the invention includes a plurality of switch phases that rotate about a first axis between a closed position and an open position relative to an unmoving electrical connection on a support member in a second axis, wherein each of the switch phases is secured to a rigid switch arm with a first end and a second end extending therefrom; a rigid interphase shaft connected to each of the second ends of each switch arm whereby displacement of the interphase shaft rotates each of the switch phases from the open position or the closed position; an overtoggle mechanism that may be mounted on a first support and rotated about a third axis between an open position and a closed that is more than 90° in rotation from the open position, the overtoggle mechanism being pivotally connected to a first end of the switch arm by a reach rod; and a handle communicating with the overtoggle mechanism that rotates the overtoggle mechanism between the closed and open positions.

The switch assembly of the present invention provides a switch operated by an overtoggle mechanism that when passing the overtoggle position snaps an adjustable stop bolt against a stop member, thereby creating positive feedback that switch blades are closed or opened with maximum force while requiring minimal operating effort for service personnel when the switch is opened or closed. The design lends itself to factory construction for advantageous quality control and optimum performance. With weather resistant structural and component materials, the switching assembly may withstand extended exposure to climatic variations without significant deterioration of switching performance.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings that form a part of this original disclosure.

DETAILED DESCRIPTION OF THE INVENTION

Figure 1:
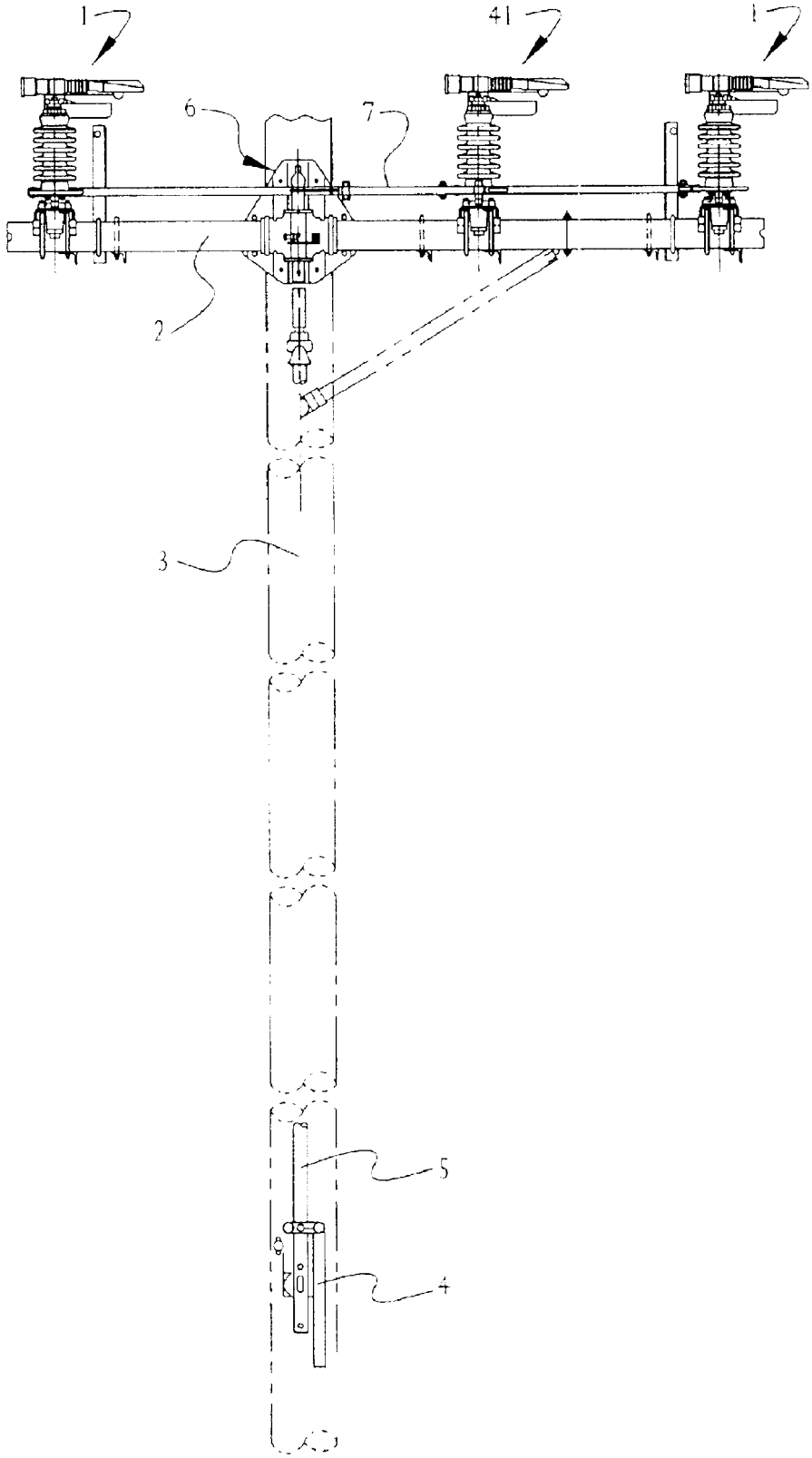
FIG. 1 is a front elevational view of a switching assembly according to the present invention on a utility pole and having a ground level handle mechanism.

The group operated switch assembly of the present invention is fully described in a brochure entitled "Hubbell Automation-Ready Distribution Systems", Bulletin No. 14–9901 (1999), which is available from Hubbell Power Systems, Inc., 210 N. Allen Street, Centralia, Mo. 65240. The entire disclosure of this brochure is hereby incorporated by reference.

Briefly described in the context of a three phase switch, the present switch assembly is made of three modular switch phases operated simultaneously by displacement of a rigid interphase shaft. The interphase shaft is initially urged to move by pivotal, rigid linkages through at least one of the switch phase levers on a switch phase module which is, in turn, pivotally and rigidly linked to an overtoggle mechanism that rotates between a closed position and an open position. The design and relative angular displacements of the overtoggle mechanism allow for a relatively easy translation with minimal effort from top dead center to a position over dead center and secured in place. Despite the security of the overtoggled position (either open or closed), minimal effort is needed to rotate the mechanism back to dead center and, with advantageous mechanical advantage now restored to the displacement stroke, the switch mechanism may be completed with relative ease. Such a mechanical advantage may often be quite necessary to overcome corroded moving parts, ice built up on the mechanism, and/or the significant repulsion forces between the switch blade and stationary contact as the blade approaches the mated electrical connection.

Preferably, the switch assembly has a modular construction based on a plurality of switch phase subassemblies mounted in alignment on the same support arm. A plurality of these subassemblies may be mounted under factory conditions on a dimensionally stable support beam and readily interconnected to an interphase shaft, overtoggle mechanism, and reach rod to form a group operated switch with proper alignment.

The switch assembly of the invention is most conveniently described with reference to the three phase horizontal system shown in FIGS. 1–4. Similar structural features will be noted with the same reference number.

Although the invention is described in connection with a three phase high voltage distribution system using a horizontal support member and three vertically disposed switches supported thereon (a "horizontal" configuration), the invention is equally applicable to a wide variety of switch assembly orientations including a delta configuration (two switches on a horizontal support with a middle switch on the pole at a higher elevation), a vertical configuration (switches extend horizontally and perpendicular to horizontal support with switches moving in a vertical plane), and phase-over-phase configurations (switches extend horizontally and perpendicular to vertical utility pole at different elevations).

The invention is also described in connection with manual operation of the switch. It is to be understood that the overtoggled switching mechanism may also be operated with a motor drive system for remote actuation of the switch linkages.

As shown in FIGS. 1–4, drive switch phase 41 and a plurality of switch phases 1 are mounted to and supported on support crossarm 2 secured at an upper end of a vertical pole 3, such as a utility pole. Preferably, support crossarm 2 is positioned horizontally and made of a weather resistant, dimensionally stable, structural material. Handle 4 acts on control shaft 5 to turn rotatable overtoggle mechanism 6, thereby displacing interphase shaft 7 and simultaneously turning switch phases 1 and 41 between open and closed positions. Preferably, handle 4 is positioned proximal the base of the pole 3 for easy operation by a user at ground level.

Figure 2:
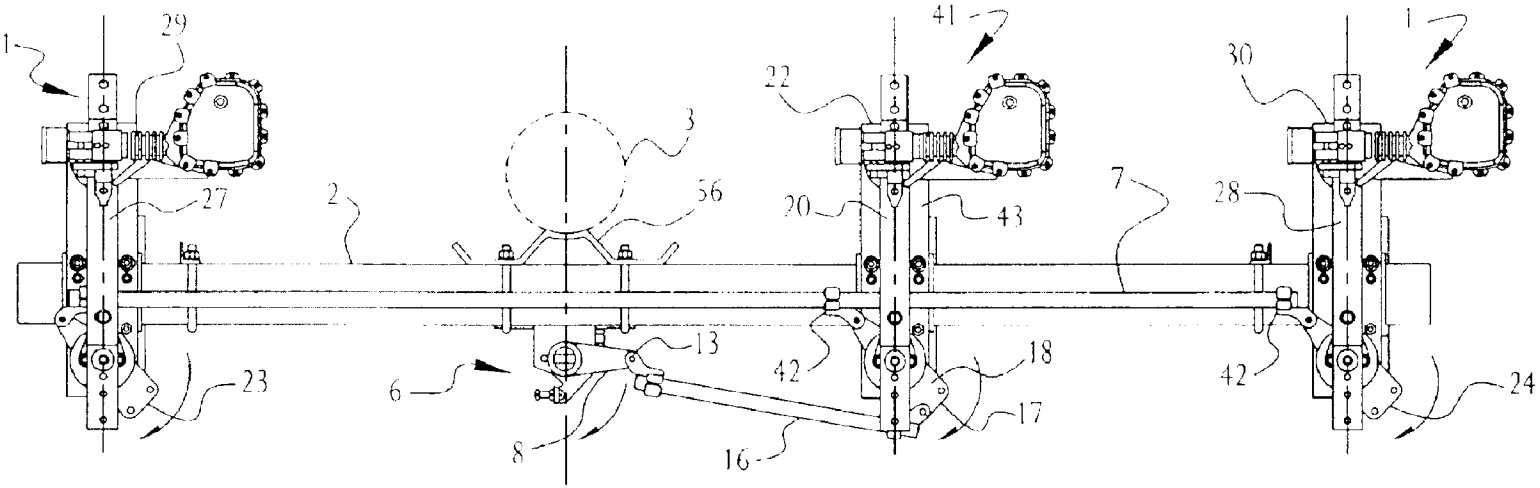
FIGS. 2 and 3 are top plan and side elevational views, respectively, of a three phase switch assembly with an overtoggled switch mechanism.
Figure 3:
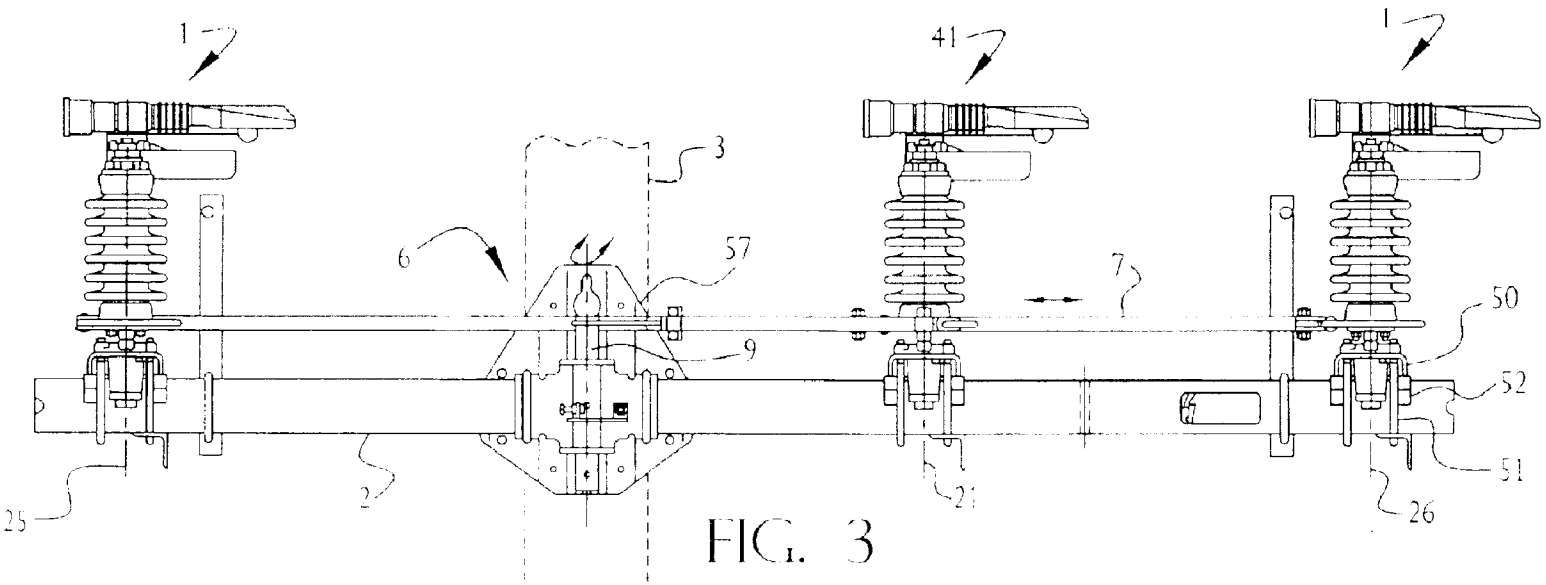
Figure 4:
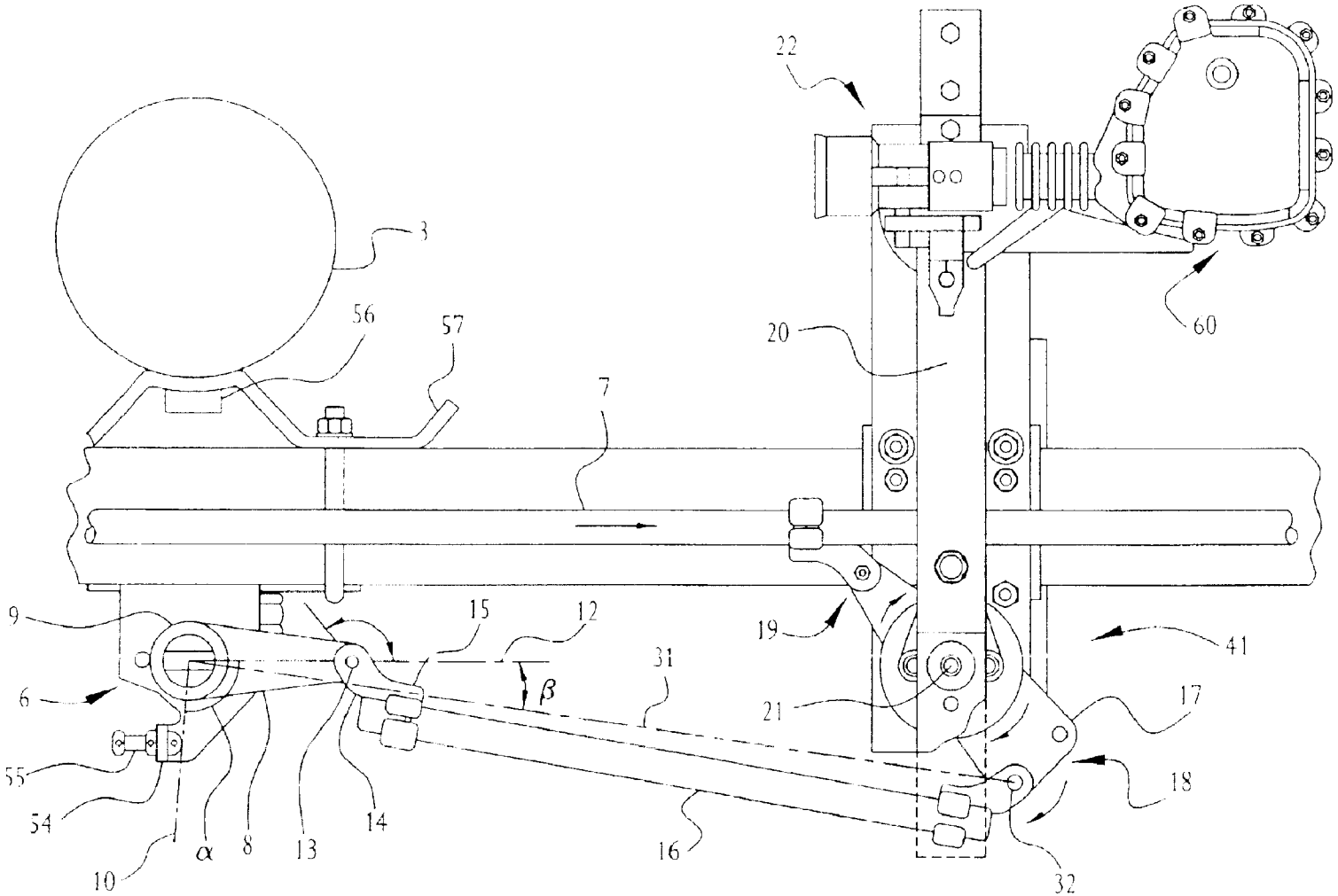
FIG. 4 is a top view of the switching switch assembly of FIGS. 2 and 3, showing a close-up of the overtoggle mechanism and drive switch phase.

As shown in more detail in FIGS. 2–4, rotatable overtoggle mechanism 6 includes overtoggle lever 8 secured to and rotating with overtoggle pipe 9. Overtoggle lever 8 is rotatable from a closed position at axis 12 to an open position at axis 10 over angle $\alpha$. Angle $\alpha$ should be more than 90° to provide an overtoggled connection. Second end 15 of overtoggle clamp 14 is secured to reach rod 16 which is, in turn, pivotally connected at switch phase lever 17 of drive switch phase 41 at first end 18. The second end 19 of switch phase lever 17 is pivotally connected to interphase shaft 7. Drive switch phase 41 with an insulator between lever 17 and switch blade 20 is secured to switch phase lever 17 between ends 18 and 19 on axis 21 so that rotation of switch phase lever 17 also rotates switch blade 20 either into or out of engagement with a corresponding stationary contact 22.

Preferably, stationary contact 22 includes an interrupter 60 (FIG. 4) that reduces or eliminates arcing as blade 20 is moved from the stationary contact 22. Preferably, as shown in FIG. 2, each switch phase has an interrupter.

Switch phases 1 are pivotally connected to interphase shaft 7 with their own switch phase levers 23 and 24. As interphase shaft 7 is displaced along support crossarm 2 by force from switch phase lever 17, switch phases 1 are pulled or pushed into rotation about parallel axes 25 and 26 (FIG. 3), which, in turn, rotates switch blades 27 and 28 relative to stationary contacts 29 and 30.

An overtoggled connection is used to prevent unintended disengagement of blades 20, 27, 28 from stationary contacts 22, 29 and 30, respectively. Overtoggle is formed by the interaction relative to the angle β between centerline 12 and centerline 31. Overtoggle is created by an acute angle relative to axis 12 of overtoggle lever 8. When overtoggle lever 8 passes through axis 31 (overtoggle line), the switch blades 20, 27 and 28 are fully closed. Continuing to rotate overtoggle lever 8 through the additional angle β once the switch blades 20, 27 and 28 are closed, provides an overtoggled closed position for the overtoggle lever 8. As the switch blades 20, 27 and 28 are closed, rotating the overtoggle lever 8 through the overtoggle angle β does not cause any further pivoting of switch phase levers 17, 23 and 24. Pivotal connection 13 allows angular force from reach rod 16 to bear on lever 8 and hold lever 8 in position. Rotation of overtoggle lever 8, however, forces reach rod 16 away from interphase shaft 7 on pivot 32 and allows switch phase lever 17 to rotate around axis 21 in a first plane and urge interphase shaft 7 to rotate all switch phases 1 and 41 in unison. The switch phases 1 and 41 rotate in a second plane that is substantially transverse to a plane through the first axis 21 about which the switch phases levers (rigid connection arms) 17, 23 and 24 rotate. Operation in reverse will close all switch phases. Either the open or closed positions of overtoggle lever 8 may be overtoggled. Alternatively, both the open and closed positions of the overtoggle lever may be overtoggled.

The overtoggled switch system of the present invention is preferably assembled under factory controlled conditions as an accurately aligned switch assembly comprising a plurality of rotatable switch phases and a corresponding number of immobile electrical connectors with mating stationary contacts on a single support member made of a dimensionally stable material that may be mounted as an integral assembly to a vertical utility pole. Such a switch assembly allows the manufacture of component switch and connector mating units that may be quickly mounted to the support beam and pivotally connected to a central control arm for group operation.

The component nature of the present assembly is best shown in FIGS. 2–4, wherein following switch phases 1 are essentially identical in construction to drive switch phase 41 except for the additional linkage of reach rod 16 to overtoggle lever 8 for operation. By using an open ended clamp 42 for securing switch phase levers 17, 23, and 24 to interphase shaft 7, switch phases 1 and 41 need to be secured to only a single crossarm support 2. Rotatable overtoggle mechanism 6 is similarly secured to support crossarm 2 under the controlled conditions of a manufacturing line or factory so that overtoggle mechanism 6 is properly positioned relative to drive switch phase 41 and the corresponding linkages.

Prior assembly of stationary contact 22 and drive switch phase 41 on the same transverse switch phase base 43 assures proper positioning of these components for proper mating of blade 20 in a mating slot of stationary contact 22. In particular, each switch phase 1 and 41 is made with a U-shaped switch phase base 50 secured with a pair of U-bolts 51 and base spacer 52 to support crossarm support 2. Base spacer 52 provides force against U-bolts 51 to secure the switch assembly to the support crossarm as well as provide a bearing surface to resist torsional forces created by the overtoggled positioning as the switch is opened and closed. Further details of base spacer 52 are set forth in U.S. Pat. No. 6,409,135, the disclosure of which is hereby incorporated by reference.

Switch phases 1, 41 are initially secured to support crossarm 2 at a position that roughly estimates the final position. Drive switch phase 41 is then connected to overtoggle lever 8 of overtoggle mechanism 6 and adjusted in length to provide an overtoggled closed position and/or overtoggled open position for overtoggle lever 8 and an open position that is at least 90° in rotational position from the opposite position. Adjustable overtoggle stop 54 is then adjusted by screw 55 to provide an overtoggle angle so that drive switch phase 41 does not accidentally close or open. Switch phases 1 are subsequently adjusted in position on support crossarm 2 so that displacement of interphase shaft 7 simultaneously opens or closes all switch phase blades. Once adjusted, all connections are tightened and secured to produce a unitary assembly that is directly mounted with bolts 56 through holes in plate 57 to utility pole 3.

Installation of an overhead power distribution switch assembly according to the invention thus includes securing a support crossarm to a support pole, wherein the support crossarm carries a plurality of pre-manufactured, pre-aligned, group operated switch phases actuated by a overtoggle mechanism having an open position and a closed position, at least one position of which is overtoggled.

While advantageous embodiments have been chosen to illustrate the invention, it will be understood by those skilled in the art that various changes and modifications may be made therein without departing from the scope of the invention as defined in the appended claims.

What is claimed is:

1. A group operated switching apparatus for an overhead power distribution system, comprising:

an overtoggle mechanism rotated between a first open position and a first closed position;

a plurality of rigid levers pivoted by said overtoggle mechanism;

a plurality of switch phases rotated between a second open position and a second closed position by said plurality of rigid levers; and wherein at least one of said first open and closed positions is overtoggled such that said overtoggle mechanism moves beyond a position corresponding to one of said second open or closed positions of said plurality of switch phases to reach said overtoggled position.

2. An apparatus according to claim 1, wherein said plurality of switch phases rotate about axes in a first plane, and said plurality of rigid levers are operated in a second plane that is substantially transverse to said first plane.

3. An apparatus according to claim 1, wherein said overtoggle mechanism includes an overtoggle lever secured to a rotatable shaft.

4. An apparatus according to claim 3, wherein said rotatable shaft is welded to said overtoggle lever.

5. An apparatus according to claim 3, wherein an adjustable stop limits movement of said overtoggle lever.

6. An apparatus according to claim 1, wherein said first open and closed positions are overtoggled.

7. An apparatus according to claim 1, wherein said plurality of rigid levers are pivotally connected to an interphase shaft.

8. An apparatus according to claim 1, wherein said plurality of switch phases are mounted on a support.

9. An apparatus according to claim 1, wherein said overtoggle mechanism is rotated manually.

10. An apparatus according to claim 1, wherein said overtoggle mechanism is rotated electrically.

11. An apparatus according to claim 1, wherein said overtoggle mechanism is rotated through an angle greater than 90 degrees between said first open and closed positions.

12. An apparatus according to claim 1, wherein an acute angle is defined between a first position corresponding to one of said first open and closed positions of said overtoggle mechanism and a second position corresponding to the position of the overtoggle mechanism when said plurality of switch phases are in said complementary second open or closed positions.

13. An apparatus according to claim 12, wherein said plurality of switch phases comprises three switches.

14. A method of operating a group operated switching apparatus for an overhead power distribution system, comprising the steps of:

rotating an overtoggle mechanism through a first angle to pivot a plurality of levers connected to the overtoggle mechanism, whereby said pivoting of the plurality of levers opens or closes the plurality of switch phases; and rotating the overtoggle mechanism through a second angle to create an overtoggle position to secure the plurality of switches in the open or closed position, whereby the plurality of levers are prevented from pivoting during said rotating the overtoggle mechanism through the second angle.

15. A method according to claim 14, wherein said rotating the overtoggle mechanism through the first angle and said rotating the overtoggle mechanism through the second angle comprises rotating the overtoggle mechanism more than 90 degrees.

16. A method according to claim 14, further comprising preventing the overtoggle mechanism from rotating more than the first and second angles with an adjustable stop.

17. A method according to claim 16, further comprising adjusting the adjustable stop to adjust the second angle through which the overtoggle mechanism rotates.

* * * * *